United States Patent [19]

Myers et al.

[11] 4,118,309

[45] Oct. 3, 1978

[54] SEPARATION AND RECOVERY OF HEAT CARRIERS IN AN OIL SHALE RETORTING PROCESS

[75] Inventors: Gary A. Myers; Yahia A. K. Abdul-Rahman, both of Plano; James L. Skinner, Richardson, all of Tex.

[73] Assignee: Atlantic Richfield Company, Los Angeles, Calif.

[21] Appl. No.: 749,505

[22] Filed: Dec. 10, 1976

[51] Int. Cl.[2] ..... C10G 1/02; C10B 53/06

[52] U.S. Cl. ..... 208/11 R; 201/3; 209/691; 209/696

[58] Field of Search ..... 208/11 R; 201/3; 209/112, 114

[56] References Cited

U.S. PATENT DOCUMENTS

| | | | |
|---|---|---|---|
| 563,238 | 6/1896 | Prinz | 209/114 |
| 1,291,278 | 1/1919 | Ulrich | 209/112 |
| 1,292,820 | 1/1919 | Lindsley | 209/114 |
| 1,744,967 | 1/1930 | Johnson | 209/114 |
| 2,658,616 | 11/1953 | Stutzman | 209/112 |
| 2,788,124 | 4/1957 | Miller | 209/114 |
| 3,020,209 | 2/1962 | Culbertson et al. | 208/11 R |
| 3,235,076 | 2/1966 | Snyder et al. | 209/114 |

*Primary Examiner*—Herbert Levine
*Attorney, Agent, or Firm*—M. David Folzenlogen

[57] ABSTRACT

In an oil shale retorting process, hot heat-carrying spherically-shaped solids are cycled to a retort zone to mix with and retort crushed oil shale, thereby producing gas and oil products and a mixture of irregularly-shaped, laminar spent shale and spherically-shaped solids. The spherically-shaped solids are separated and recovered from the spent shale for recycle through the process. In one stage of the separation procedure, a mixture of spent shale and spherically-shaped solids is fed to a continuously restored inclined surface whereon the spherically-shaped solids roll from the surface while the irregularly-shaped spent shale solids are separately removed from the inclined surface. Continuous restoration of the inclined surface is achieved through movement of the feed and the impingement area of the inclined surface relative to each other. The separation system may be used for separating other types of spherically-shaped solids which will roll from nonspherical, irregularly-shaped solids which do not roll.

33 Claims, 11 Drawing Figures

SEPARATION AND RECOVERY OF HEAT CARRIERS IN AN OIL SHALE RETORTING PROCESS

BACKGROUND OF THE INVENTION

This invention relates to an improved oil shale retorting process and a separation system for recovering spherically-shaped solids, for example, heat carriers, from irregularly-shaped solids, for example, spent shale. In the oil shale retorting process, heat-carrying spherically-shaped solids are rolled down a continually restored, moving inclined surface to separate these heat carriers from irregularly-shaped spent shale. The heat carriers are then recycled through the retorting process.

It has been proposed to use heat-carrying spherically-shaped solids to retort the solid carbonaceous organic solid matter (commonly called kerogen) in oil shale to produce petroleum products. The sphercially-shaped solids are heated and these hot heat carriers are mixed with crushed oil shale. The heat from the hot heat-carrying solids helps to convert the kerogen in the oil shale to oil and gas and produces a mixture of spherically-shaped solids and irregularly-shaped spent shale solids. The sphercially-shaped solids of a significant size are separated from the irregularly-shaped spent shale solids so that the spherically-shaped solids may be heated and recycled through the retorting process. The spherically-shaped solids must be separated in a dry system wherein dust and other emissions into the atmosphere are controlled. In addition, the mixture of spherically-shaped solids and irregularly-shaped spent shale may be separated at relatively high temperatures, e.g., 204° C. (400° F.) to 538° C. (1000° F.). These temperatures place severe limitations on equipment selection and limit the number of pieces of equipment, especially moving parts, which may be used.

A commercial oil shale plant using recycled spherically-shaped solids may retort as much as 50,000 metric tons (about 55,000 short tons) to 118,000 metric tons (about 130,000 short tons) of raw crushed oil shale per day with varying oil yields per ton. This will require recovery and recycle of one to three times as many tons of the heat-carrying spherically-shaped solids per day. The capacity of the system for separating the spherically-shaped solids will, therefore, be quite large while the plant space allocated to the separating equipment will be limited. The amount of spherically-shaped solids being separated and recycled may also fluctuate widely depending on the richness of the raw oil shale and on other process conditions. It is, therefore, desirable that the separating system adequately separate the spherically-shaped solids with a low loss of spherical heat carriers over a wide range of mass flow rates of spherically-shaped solids and spent shale. This combination of objectives is difficult to achieve. For example, a reduction in loss of spherically-shaped solids with the spent shale tends to be offset by an increase in the amount of spent shale retained with the recycled spherically-shaped solids. By the same token, an increase in mass flow rate of the mixture tends to increase loss of spherically-shaped solids, or retention of spent shale, or both. As hereafter mentioned, this combination of objectives is impractical with separating systems which rely on gravity or size differences, and some other proposals tend to increase attrition of the spherically-shaped solids.

In a process of the type described in U.S. Pat. No. 3,844,929, the heat-carrying solids are special porous pellets having a surface area of at least 10 square meters per gram and a size ranging from approximately 0.04 centimeter (0.055 inch) to approximately 1.27 centimeters (0.5 inch). In this process, a combustible deposition is formed on the pellets. This deposition is burned to reheat the pellets. In this process, it is especially important that the pellets be recovered from the spent shale and that only a small amount of spent shale, if any, be retained with the pellets. The pellets are relatively costly and bear the combustible residue which acts as fuel for heating the pellets. In addition, an excessive amount of retained spent shale will interfere with proper gas and solids flow through the burning zone and will foul the burning zone wherein the deposition on the pellets is burned. Yet, these special pellets are especially difficult to separate from spent shale.

Unlike certain of the other solid heat carriers previously suggested, porous-type pellets undergo size reduction as they are cycled through the retorting system; consequently, the size range of the pellets and the spent shale particles overlap and the two particulate materials frequently have relatively similar specific gravities. This renders separating systems relying on gravity or size differences relatively ineffective. In U.S. Pat. No. 3,803,021, a combination elutriation-size separating system is provided, but this combination system has certain disadvantages. As a result, even though the degree of separation required for the pellet process is greater than that required for some other oil shale retorting processes, the porous pellets are particularly difficult to separate from the spent shale by known means which for the most part rely either on size difference, gravity difference, or elutriation velocity difference.

During a search for an improved separating system, it was learned that the manufacturers of lead shot for shotgun shells once used an inclined surface whereon the round shot rolled down fast enough to jump a slot in the surface while the faulty, out-of-round shot rolled down the surface and fell into the slot. In this system, the surface as inclined at an angle such that the faulty shot moves down the surface at a significant rate, but not fast enough to jump the slot. In a system like this, it seems likely that at a high feed rate per unit of surface area, some of the spherical shot will inherently be deflected into the slot. In the lead shot industry of the past, this may not have been too much of a problem since the out-of-round shot was not a waste material. The rejected shot was probably recycled through the melting and shot forming process. In constrast, in an oil shale process the spent shale is waste material which must be disposed of and pellets carried off with the spent shale are lost. The likelihood of loss of pellets with spent shale might be reduced by reducing the feed rate per unit of surface area, but it would require an enormous sheltered surface area to handle the thousands of tons of heat carriers per day that are cycled in an oil shale retorting process and to provide the desired control over dust and other atmospheric emissions and handle the high temperature involved in oil shale retorting. Nevertheless, it was conjectured that the rolling separation concept might be applied to separating spherical heat-carrying solids from irregularly-shaped, laminar-like spent oil shale solids even though the spent shale would not roll like out-of-round lead shot and did not have the high specific gravity of lead. This led to the improved oil shale retorting process of this invention wherein solid, heat-carrying spherically-shaped solids, especially porous pellets, are separated and recovered from spent shale using a unique separation stage. The separation stage untilizes the face that spherically-shaped solids, e.g., porous pellets, will roll down an inclined surface faster than irregularly-shaped, nonspherically-shaped solids, e.g., spent shale, will slide down an inclined surface, and a continuously restored appropriately inclined surface, that is, an appropriately inclined surface and a particle feed arrangement wherein the two move in a single, continuous direction relative to each other. The surface is inclined at an angle such that the irregularly-shaped solids do not move readily down the surface simply as a result of the force of gravity. The continuously restored inclined surface separating system enables the previously recited conditions to be satisfied, that is, for example, it provides a dry, high temperature system not dependent on gravity or size differences and that is flexible and has few moving parts, large capacity, high feed rate, and good separation with low spherical particle loss and size attrition. The system may be used for separating other spherical solids from nonspherical, irregularly-shaped solids, that is, solids with some flat, rough or laminated sides, especially when standard separating techniques relying on density or gravity differences, or on size, would not be as efficient.

SUMMARY OF THE INVENTION

Mined oil shale, which contains solid carbonaceous and other mineral matter and which has been crushed and may have been preheated, is retorted in a retort zone with hot, heat-carrying, spherically-shaped solids. Retorting the oil shale produces gas and oil products, which are recovered, and a mixture of the spherically-shaped solids and irregularly-shaped, laminar-like, particulate spent shale.

After the oil shale is retored, seventy-five percent by weight or more of the spent shale in the solids mixture from the retort zone is separated in the separation stage of the process from the total mixture and sent to disposal, that is, the separated spent shale is not recycled through the retorting process. During one total process cycle of the spent shale separation part of the process, eightly percent by weight or more of the spherically-shaped solids of a significant size are recovered in order that they may be reheated and recycled to the retort zone.

Separation of the spherically-shaped solids from the spent shale may be accomplished in one or more stages. In at least one stage, which is preferably preceded by one or two other separation stages, a mixture of spherically-shaped solids and spent shale are fed onto an inclined surface whereon the spherically-shaped solids tend to roll down the surface appreciably faster than the irregularly-shaped spent shale will slide down the surface. As a result, the particulate materials are separated according to shape factor rather than gravity, or size, or elutriation velocity differences. In order for these solids to be separated in this manner by their shape or rolling factor, the solids will need to contact the inclined surface which is appropriately inclined to let the spherically-shaped solids roll appreciably faster than the irregularly-shaped solids slide. Generally, the irregularly-shaped solids will come to rest on the inclined surface. In order that the needed contact may be obtained, especially with the large volumes of solids that may be required for an oil shale retorting facility, the inclined surface must be continuously restored, that is, the inclined surface and solids feed system generally move in a continuous net direction relative to each other so that the solids impinge on a continuously changing, continuously restored area of the inclined surface. In other words, the inclined surface moves relative to the feed system, or vice versa, in a way that the impingement area continuously changes. There are significant advantages to moving the impingement area of the inclined surface relative to the feed system. Restoration or renewal of the inclined surface also requires that significantly sized solids be removed from the inclined surface.

Upon removal from the surface, the spherically-shaped solids are received and collected by appropriate means so that the spherically-shaped solids may be eventually reheated and recycled to a retort zone; and the irregularly-shaped solids, or spent shale, are received and collected by appropriate means for eventual disposal, that is, the separated spent shale is not recycled to the retort zone.

The improved oil shape retorting process of this invention is especially advantageous for a retorting process wherein the spherically-shaped solids of a significant size are comprised of spherically-shaped pellets or heat carriers in a size range between approximately about 0.14 centimeter (0.055 inch) and 1.27 centimeters (0.5 inch) and have a surface area of between 10 and 150 square meters per gram.

Several embodiments of separating systems utilizing an inclined surface are provided herein. In one embodiment, the inclined surface is a conically-shaped member which rotates about its vertical axis so that the continuously changing impingement area moves in a circular path and the irregularly-shaped solids are removed from the inclined surface by the various means, such as, for example, by a scraper, a brush, or an air jet which create a removing force on the irregularly-shaped solids thereby changing the direction of movement of the solids while they are still on the inclined surface. In other embodiments, the inclined surface is an inclined moving conveyor belt-like member whereon the irregularly-shaped solids may be removed by similar means or forces or by simply falling off one end of the conveyor belt-like member as it rotates around one of its ends. The conveyor belt-like member may be adapted to rotate in either direction. In one embodiment it moves in a downward direction and a spaced-apart deflector plate allows the spherically-shaped solids to fall on one side while the irregularly-shaped solids fall on the other side. The conveyor belt-like member may be inclined along its longitudinal axis or inclined sideways.

The continuously restored inclined surface separating system for separating spherically-shaped solids which tend to roll from irregularly-shaped solids which tend to slide rather than roll may be used for purposes other than oil shale retorting, especially when a dry system is required and systems relying on gravity, size, or elutriation velocity differences would not be as desirable as the inclined surface system.

DETAILED DESCRIPTION OF THE INVENTION.

In an oil shale retorting process using hot, spherically-shaped heat carriers to heat the oil shale, the heat carriers must be separated from the spent retorted mineral matter in the oil shale so that the heat carriers may be reheated and recycled to the retort. This invention relates to a separation system for this type of retorting process. The separation system may be employed in other solids separation facilities wherein spherically-shaped solids are separated from irregularly-shaped solids.

The separation system is particularly advantageous to a porous pellet retorting process for reasons herein made apparent. For example, these pellets undergo size attrition. They have a size range which overlaps the size of spent shale and a specific gravity relatively close to spent oil shale mineral matter. They act both as a heat carrier and as a fuel carrier. Recycle of spent shale tends to throw the retorting system out of balance and to interfere with proper combustion of the fuel on the pellets and proper gas and solids flow.

Figure 1:
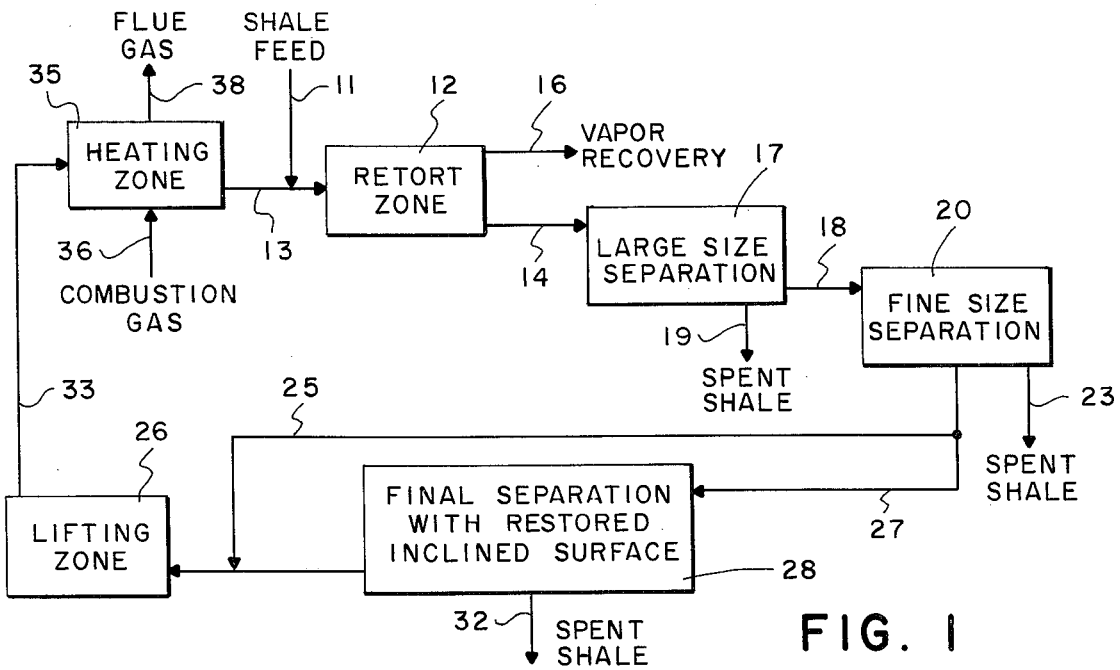
FIG. 1 is a schematic flowsheet of a retorting process employing an inclined surface separation stage.
Figure 2:
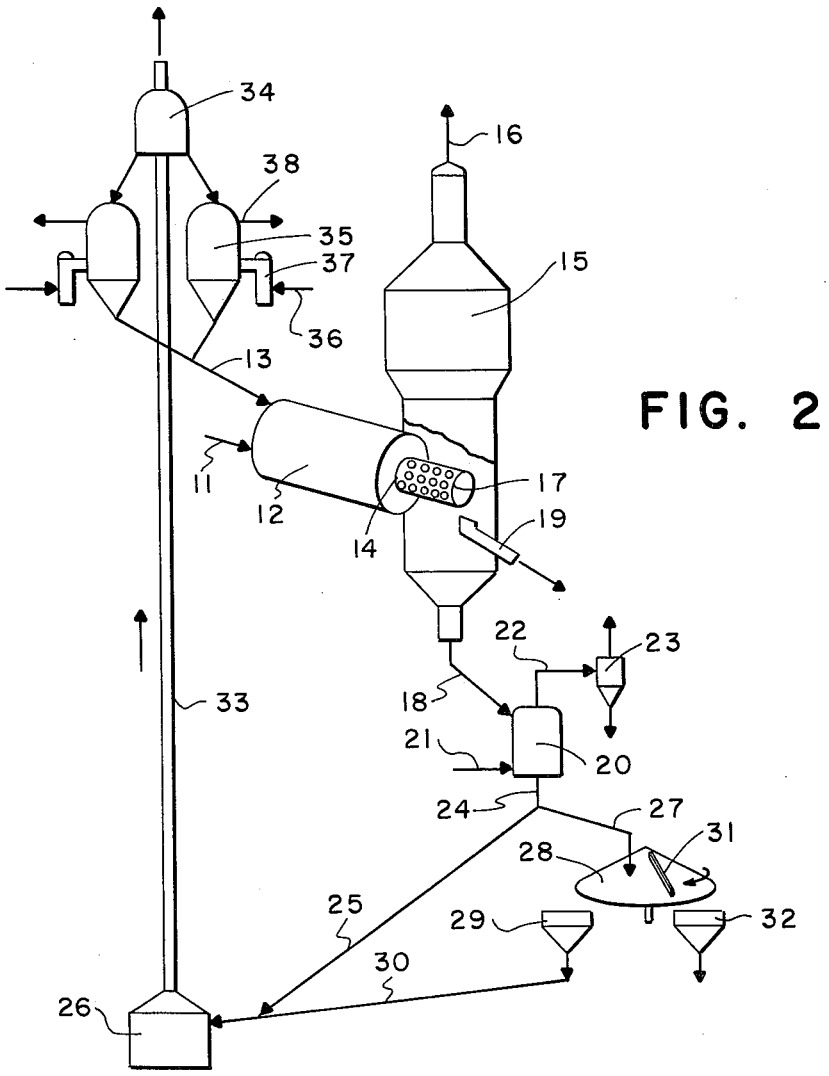
FIG. 2 is a partly schematical, partly diagrammatical flow illustration of a retorting process using porous, spherically-shaped heat carriers and an inclined surface separation stage after two other separation stages.

Although FIGS. 1 and 2 primarily illustrate a porous pellet retorting process, these figures also serve to illustrate any retorting processes using heat-carrying, spherically-shaped solids. In these retorting processes, mined oil shale crushed by a particle diminution process to a suitable size is fed by way of shale inlet line 11 to retort zone 12 where oil shale is mixed with hot heat-carrying, spherically-shaped solids. These particulate solids are fed by way of gravity or other mechanical means to the retort zone by way of heat-carrier inlet pipe 13. The heat carriers and the shale feed stock could be fed to the retort zone by way of a common retort zone inlet.

Chunks of mine run oil shale may be quite large; therefore, it is necessary to crush the mined oil shale in a retorting process using hot, solid heat carriers. Crushing facilitates uniform mixing, contact and heat transfer between the shale feed stock and the hot spherically-shaped heat carriers. The degree of crushing usually depends on an economic balance between the cost of crushing and the advantages to be gained by crushing. Generally, in a retorting process of this nature, the shale feed stock is crushed to a size of about a nominal 1.27 centimeters (0.5 inch) with the resulting shale particles being both larger and smaller than 1.27 centimeters.

The crushed oil shale may or may not be preheated before it is fed to the retort zone. If the shale feed stock is preheated, the temperature of the feed stock will usually not exceed 316° C. (600° F.). The shale feed stock will usually be fed by way of a metered weight controller system so that the proper ratio of heat carriers to raw shale is maintained.

Retort zone 12 is any sort of retort wherein the crushed oil shale feedstock and hot heat carriers are intimately mixed. The retort zone illustrated in FIG. 2 is an inclined retorting drum that causes the oil shale and heat carriers to undergo a sort of tumbling action. This sort of retort is herein referred to as a rotating retort zone. This type of retort zone is flexible over a wide range of process conditions and is especially suited to retorting with hot, porous, heat-carrying, spherically-shaped, particulate solids of the type hereinafter described. This type of retort zone causes rapid solid-to-shale heat exchange which in turn causes flashing and pyrolysis of the kerogen in the oil shale to gas and oil vapors. It also provides efficient separation of these petroleum products from the solids in a way that lessens redeposition of the petroleum vapors and minimizes dilution of the product vapors by extraneous undesirable retorting gases. The rotating retort allows a high shale throughput and product yield per unit retort volume. It provides for increased control over residence time and prevents overcoking and agglomeration of the retort solids. It also causes the solids to move through the retort in a manner which eventually aids separation of the spherically-shaped solids from the spent mineral matter in the oil shale. When the hereinafter mentioned porous heat-carrying pellets are used, the rotating retort zone facilitates formation of a more uniform controlled amount of combustible carbon-containing deposition on the internal surface area of the pellets.

The hot heat-carrying, spherically-shaped solids are fed to the retort zone at a temperature ranging between 538° C. (1000° F.) and 816° C. (1500° F.) which is significantly higher than the designed retort temperature within the retort zone. The quantity of hot heat-carrying solids is controlled so that the heat carrier-to-shale feed stock ratio on a weight basis is such that the sensible heat in the heat carriers is sufficient to provide a significant portion (for example, at least fifty percent) of the heat required to heat the shale feed stock from its retort zone feed temperature to the designed retort temperature. The feed stock feed temperature is the temperature of the oil shale after preheating, that is, the temperature of the shale upon entry into the retort zone. The average retort temperature ranges between about 454° C. (850° F.) and about 649° C. (1200° F.), depending on the nature of the shale feed stock, the ratio of heat carriers to oil shale, the product distribution produced in the retort zone, heat losses and the like. The preferred range of heat carrier-to-shale feed stock ratio is between 1 and 3 on a weight basis.

The retorting process of this invention includes a separation stage which relies on an inclined surface to separate solids by a difference in roll factor. The heat carrier solids must, therefore, be sufficiently spherically-shaped to roll down the inclined surface. The sphericity factor of these spherically-shaped solids, for the most part, will be at least 0.9, that is, 0.9 or greater. The sphericity factor is the external or geometric surface area of a sphere having the same volume as the spherically-shaped solid divided by the external surface area of the spherically-shaped solid.

The spherically-shaped solids are made up of materials, such as ceramics, alumina, or silica alumina, which are not consumed in the retorting process. They are sufficiently wear or breakage resistant and heat resistant to maintain enough of their physical characteristics under the conditions employed in the process to satisfy the requirements of the retorting process.

The oil shale retorting process of this invention is especially advantageous for retorting process of the type described in U.S. Pat. No. 3,844,929, that is, a retorting process wherein the hot spherically-shaped solids are comprised of spherically-shaped, subdivided or particulate solid heat carriers having a minimum relatively high internal surface area of 10 square meters per gram and higher in a size range of between about 0.14 centimeters (0.055 inch) and 1.27 centimeters (0.5 inch). The preferred size range is between about 0.14 centimeters (0.055 inch) and 0.953 centimeters (0.375 inch). Preferably, the average surface area of the heat carrier pellets will be between 10 and 150 square meters per gram. The surface area is the average effective surface area of the heat carrier pellets as they enter the retort zone. The surface area may be determined by the conventional nitrogen absorption method.

In the porous pellet process, the pellets act both as a heat carrier and as a fuel carrier. In the retort zone, a combustible carbon-containing deposition or residue is formed or deposited on the relatively high internal surface area of the porous pellets if the effective surface area of the pellets has not already been covered with all of the deposition that it can sustain. The amount of combustible deposition formed or deposited on the pellets upon one passage through the process is sufficient upon combustion to provide at least fifty percent of the heat required to reheat the pellets. The amount of combustible deposition deposited during the retorting stage is on an average less than 1.5 percent by weight of the pellets, for example, 0.8 to 1.5 percent by weight. The pellet surface area, size, and amount coact with other retort process conditions to accomplish the desired amount of combustible deposition and petroleum product distribution. If the surface area of the pellets is less than 10 square meters per gram, either too little total deposition will be formed or the burning of the deposition will not be sufficient to provide a major portion of the heat required to heat the pellets to the desired temperature and to carry out the retorting phase of the retorting process. Since the pellets bear this fuel and are relatively costly, it is particularly important that there be a low loss of porous pellets with the spent shale. It is also particularly important that a lot of spent shale not be recycled with the pellets. Recycled spent shale increases the amount of solids that must be reheated by burning the fuel deposited on the pellets. Recycled spent shale also interferes with proper combustion control and gas flow through a bed of pellets when the fuel on the pellets is being burned. Unfortunately, although the porous pellets are sufficiently wear and heat resistant to prevent undue loss of surface area, they do undergo size reduction as they are cycled through the retorting system. This attrition combined with pellet makeup increases the size range of the pellets. Particular effort is made to retain and recover pellets above about 0.15 centimeter (0.06 inch). Finer grain pellets may be retained and recovered, but no special effort is made to retain these finer grain pellets. On a once through basis, several percent by weight and more of the total spent mineral matter in the oil shale is likely to be in the same size range as the pellets that are to be retained and recovered. Of course, if an appreciable amount of strong spent shale is recycled with the pellets, this percentage will increase. It is particularly difficult to separate these porous pellets from spent shale of the same size by ordinary means. The separation system of this invention is, therefore, particularly useful for the porous pellet retorting process.

Returning now to FIGS. 1 and 2, it will be noted that the oil shale feed stock and the hot, heat-carrying spherically-shaped solids move concurrently through retort zone 12. In the retort zone the hotter spherically-shaped heat carriers admix with the cooler crushed shale feed stock upon their being charged into the retort zone. The shale particles are rapidly heated by sensible heat transfer from the heat carriers to the shale. As a result, water in the shale is vaporized and kerogen or carbonaceous matter in the shale is decomposed, vaporized, and cracked into gaseous and condensible oil fractions, thereby forming a valuable vaporous effluent including gas, oil vapors, and super heated steam. Pyrolysis and vaporization of the carbonaceous matter in the oil shale leaves irregularly-shaped, laminar-like particulate spent shale in the form of the spent mineral matrix matter of the oil shale and a relatively small amount of unvaporized or coked organic carbon-containing material. In a typical retort system, there will be approximately one metric ton of spent shale for every one to three metric tons of spherically-shaped heat carriers. The irregularly-shaped spent shale and the heat carriers are intimately mixed and form a mixture of solids which will be separated as hereinafter described.

If the retort system utilizes spherically-shaped porous pellets, as previously described, a combustible carbon-containing deposition or residue will be formed or deposited on the pellets during the retort phase of the process.

The mixture of spherically-shaped solids and shale moves through the retort zone toward retort exit 14 and the gaseous and vaporous effluents containing the valuable hydrocarbon materials separates from the mixture. The residence time of the shale in the retort zone will depend upon the system and the flow or movement characteristics of the mixture. Shale residence times vary, but they are usually on the order of about 3 to about 20 minutes.

The mixture of spherically-shaped heat carriers and irregularly-shaped spent shale exits from retort zone 13 by way of retort exit 14 into recovery chamber 15 where the gaseous and vaporous products are collected overhead and passed overhead retort products line 16. The product vapors exit the retort zone at a temperature which depends upon the process and which usually lies between 400° C. (750° F.) and 566° C. (1050° F.). The product vapors are usually subjected to hot dust separation and the dust thus separated is collected and may be combined and handled with other spent shale for proper disposal.

The mixture of spherically-shaped solids and irregularly-shaped spent shale exits the retort zone at a temperature which also depends upon the process, but which usually lies within the aforementioned temperature range for the vaporous products. The mixture of particulate solids from the retort zone is then passed through a separation and recovery system wherein at least 80 percent by weight of the spherically-shaped bodies in a significant size range are recovered for recycle to a retort zone. As previously mentioned, in a porous pellet retorting process, the significant size range covers the spherically-shaped particles which are 0.15 centimeters (0.06 inch) in size and larger. In the porous pellet retorting process, it is desirable that at least 95 percent by weight of the spherically-shaped pellets are recovered. At the same time, at least 75 percent by weight of the spent shale in solids mixture from the retort zone is separated in the separation stages of the process from the mixture and disposed. The separated spent shale may be disposed as waste or used for some other purpose. In most retorting processes using solid heat carriers, it is desirable and sometimes even necessary to separate more than 75 percent of the spent shale. For example, in a porous pellet process, it is desirable that 80 percent of more of the spent shale be separated from the solids mixture from the retort.

The separation and recovery system for handling the solids mixture will include one or more stages. In any event, for purposes of this invention, at some time during the separation and recovery part of the process, a mixture of spherically-shaped solids and irregularly-shaped spent shale must be fed onto an inclined surface whereon most of the spherically-shaped solids fed onto the inclined surface roll from the surface while most of the spent shale fed onto the surface remain on the surface until they are removed. The spent shale particles remaining on the inclined surface are removed from the inclined surface at a point away from the point where the mixture is fed onto the surface. For reasons made apparent herein, the point of removal must be away from the point of contact or feed, otherwise the inclined surface would not function properly. The spent shale removed from the inclined surface will normally be sent to disposal or to further separation processing if the amount of spherically-shaped solids retained with spent shale warrants. The spherically-shaped solids which have rolled from the inclined surface will be collected. Normally, these spherically-shaped solids will be sent to a reheating zone and recycled to the retort zone unless further separation and recovery processing is warranted. The relative amounts and sizes of the solids in the mixture fed onto the surface will depend on other steps taken to separate spent shale and recover spherically-shaped heat carriers from the retort zone as hereafter illustrated. The inclined surface separation stage will perform much more efficiently if a significant amount of the spent shale particles smaller than the spherically-shaped bodies are removed prior to processing some of the mixture on the inclined surface. A large percentage of the spent shale will be smaller than the spherically-shaped solids. Removal of this fine material improves the roll factor separation characteristics of the inclined surface. By the same token, in some retorting processes, for example, the porous pellet retorting process, the inclined surface separation system will operate more efficiently if spent shale and other particles larger than the spherically-shaped solids are removed.

This is illustrated in FIGS. 1 and 2 wherein the mixture of solids exiting the retort zone through retort exit 14 are passed through a first separation stage represented by revolving screen or trommel 17 extending into product recovery chamber 15. In this first separation stage, spent shale particles and agglomerates larger than the spherically-shaped solids are at least partially removed from the mixture. As shown, this is accomplished by openings or apertures sized to pass the spherically-shaped solids and spent shale on the same or smaller size than the spherically-shaped solids and to screen out the larger size irregularly-shaped solids. Most of the spent shale and the spherically-shaped solids flow through the first separation stage, that is, through the openings in trommel 17 and drop to the bottom of recovery chanber 15 to exit via exit line 18. As shown, spent shale, mineral matter, and agglomerates too large to pass through the openings in the trommel pass outward through exit 19 for spent shale disposal. This prescreening or initial first separation stage of the spent shale larger than the spherically-shaped solids is optimal and may be delayed until a later or final stage of the separation system is needed. A rotating retort makes initial screening for removal of the larger size solids easier and more efficient.

Also as shown, the first separation stage for removal of larger size solids is followed by a second separation stage for removal of spent shale solids smaller than the spherically-shaped solids that are to be recovered. As shown, the spent shale and spherically-shaped solids remaining after the first separation stage pass through exit line 18 at a relatively high temperature, for example, between 400° C. (750° F.) and 566° C. (1050° F.) where the remaining mixture of particulate solids are passed by suitable means of conveyance to a second separation stage for removing at least a portion of the spent shale solids smaller than the spherically-shaped solids. The second separation stage may be any system for removing larger size particles from smaller size particles, such as, for example, screening, elutriation, the inclined surface of this invention, or a combination thereof.

The second separation stage illustrated in FIG. 2 is low velocity gas elutriation system 20. In this second separation stage, a significant portion of the spent shale which is amaller than the spherically-shaped solids is removed by counter current flow of an elutriating gas from entering by way of line 21 and passing upward through elutriation system 20. The elutriator will be operated at a velocity high enough to remove a major portion of the small spent shale, but not high enough to damage or remove the spherically-shaped solids in the solids mixture being processed. In other words, the elutriation velocity of the gas will be below the elutriation velocity of the smallest size spherically-shaped solids that are to be recovered. As previously mentioned, this size will normally be above 0.15 centimeter (0.06 inch). The internal operation and design of gas elutriators is well known. This design takes into consideration such factors as the properties of the solids, the free board height, bed height and weight, gas type and velocity, column diameter and cross-sectional area, and transport disengaging height. In a porous pellet retorting process of the type illustrated, the design and operating conditions will take into consideration the fact that porous pellets tend to undergo attrition if the gas velocity is high enough to fluidize the pellets. In such cases, the gas elutriation velocity will generally be below 20 feet per second. Also, in the porous pellet process, a noncombustion supporting gas will be used for the elutriator since the pellets act as a fuel carrier. Preferably, the gas will be heated. The gas may be hot flue gas or steam or any other gas which will preferably be a noncombustion supporting gas.

The elutriation gas with the separated small spent shale passes out of the elutriator through overhead line 22 to the cyclone 23 where the spent shale is collected. The spent shale thus collected will normally be combined and handled with other spent shale from the retorting process for eventual disposal either as waste or as a base material for some other product. The remaining mixture of spherically-shaped solids and spent shale are passed from the elutriation system through exit line 24. In this invention, as illustrated, it is essential that at least a portion of this remaining mixture be treated for further separation on an inclined surface. The amount of remaining mixture that is treated in this manner will depend on the amount of spent shale remaining in the mixture. In some instances, it may be necessary to only treat a portion of the remaining mixture to achieve the necessary degree of spent shale separation from the spherically-shaped solids prior to their being reheated as hereinafter discussed. As shown, part of the remaining mixture passes by way of line 25 to lifting system 26 where the spherically-shaped solids are lifted to a reheating zone.

A portion of the remaining mixture from the elutriation system is fed by way of line 27 at a first or feed point onto an impingement area of inclined surface 28. For reasons hereinafter made apparent, the feed point may be thought of as having a first and a second boundary or side. On the inclined surface, most of the spherically-shaped solids fed onto the inclined surface roll from the inclined surface to collecting system 29 for the spherically-shaped solids. The spherically-shaped solids thus collected are passed by way of line 30 to lift system 26.

In contrast, most of the spent shale fed onto the inclined surface remains on the inclined surface. As illustrated, the inclined surface is the outer surface of a conically-shaped member with its apex pointing up. This conically-shaped member rotates about its vertical axis in the direction shown so that the impingement area is continuously changing in a circular path around the vertical axis of the conically-shaped member and so that the portion of the inclined surface with spent shale thereon moves away from the first side or boundary of the feed point and returns to the second side or boundary of the feed point before returning to the first side of the feed point. The inclined surface may be vibrated or shaken, but for the most part it moves in a constant, circular net direction while the mixture via line 27 is being fed onto the inclined surface. The spent shale particles on the inclined surface rotate around the axis in a first direction until they contact scraper 31 which changes the direction of movement of the spent shale and removes the spent shale from the inclined surface at a point away from the point where the mixture is fed onto the inclined surface. The scraper and the constant rotation of the inclined surface combine to create a downwardly directed component of a force on the spent shale which causes the spent shale to change direction and move downward off the inclined surface. The spent shale removed by scraper 31 is collected in a suitable system depicted by collector 32 for disposal of the spent shale in the manner previously mentioned.

After the necessary amount of spent shale has been separated from the solids mixture from the retort zone, the remaining spherically-shaped solids are cycled back to a heating zone to be reheated. In most retorting processes using recycled solid heat carriers, the heat carriers are lifted to a heating zone which is close to the retort zone so that the hot heat carriers may be fed to the retort zone without a significant loss of heat. The heat carriers may be lifted by gas, ball elevator, conveyor belt, or the like.

As shown in FIG. 2, lift system 26 for the spherically-shaped heat carriers is a gas system where the spherically-shaped solids collected from the separation system are gas lifted through return line 33 to surge hopper 34 for collecting the spherically-shaped solids. If the spherically-shaped solids are porous pellets bearing a combustible fuel deposition, the gas used to lift the pellets will usually be a noncombustion supporting gas.

The spherically-shaped solids are fed by gravity or other suitable means to heating zone 35 which may be any suitable heating zone for reheating the spherically-shaped solids to the desired temperature, that is, a temperature which enables the hot heat carriers to be fed to the retort at a temperature ranging between 538° C. (1000° F.) and 816° C. (1500° F.).

In FIG. 2, heat zone 35 is a pellet deposition burning zone. As previously mentioned, in the porous pellet retorting process, the pellets bear a combustible deposition which was absorbed or deposited during the retorting stage of the process. This combustible deposition is burned in heating zone 35 to provide at least 50 percent or more of the heat required to reheat the spherically-shaped pellets to the temperature required to effect retorting of the oil shale. The combustible deposition is burned in a manner similar to the way that cracking catalyst particles are regenerated. The burning process is designed to avoid excessive heating of the porous spherically-shaped pellets so as to avoid excessive reduction in the effective surface area of the pellets to less than 10 square meters per gram. A progressive bed burner with a gas flow of about 1 to 2 feet per second is preferred. A combustion supporting gas, for example, air, a mixture of air and fuel gas generated in the process, or flue gas with the desired amount of free oxygen, is blown into the depostion burning-heating zone at a temperature at which the deposition on the porous spherically-shaped pellets is ignited by way of combustion gas inlet 36. Steam may also be used to control burning provided that the steam does not excessively reduce the surface area of the porous spherically-shaped solids. The combustion supporting gas may be preheated in heaters 37 by burning some of the gases produced in the process to reheat the porous spherically-shaped pellets to the minimum ignition temperature. The quantity of combustion supporting gas, for example, about 4.5 kilograms (10 lbs.) to about 6.8 kilograms (15 lbs.) of air per 0.45 kilograms (1 lb.) of deposition affects the total amount of deposition burned and the heat generated by such burning and, in turn, the temperature of the pellets. The bulk density of the pellets is about 18.2 kilograms (40 lbs.) to 22.7 kilograms (50 lbs.) per 0.85 cubic meters (1 cubic foot). The specific heat of the porous spherically-shaped pellets varies between about 0.2 and 0.3 gram-calorie per gram per degree Celsius. The gross heating value of the carbon-containing deposition is estimated to be about 8,333 to 10,000 gram-calories per gram (15,000 to 18,000 BTU per lb.). The amounts of carbon dioxide and carbon monoxide produced in the flue gases created by burning the depostion on the porous spherically-shaped pellets indicate the amount of combustion supporting gas required or used and the amount of carbon-containing deposition not burned. Generally, it is desirable to attempt to free the pellets of deposition. Other factors taken into consideration during burning of the deposition are the porosity, density, and size of the spherically-shaped pellets, the burner chamber size and bed size, residence burning time, the desired temperature for the heat carriers, heat losses and inputs, the heat carrier and oil shale feed rates to the retort zone, dust content, and the like. The residence burning time will usually be rather long and up to about 30 to 60 minutes. Combustion of the deposition should be controlled in a manner which does not heat the porous spherically-shaped pellets to above 816° C. (1500° F.). The hot flue gases generated in the deposition burning zone may be removed by burning zone exit line 38 and used to preheat cool raw shale feed stock or for heat transfer in some other part of the oil shale facility. Of course, additional fuel material or gases may be used to supplement the burning of the deposition on the porous spherically-shaped pellets if this is necessary.

The hot temperature burning conditions in the heating zone tend to cause spent shale particles carried into the zone to undergo more complete retorting, size attrition or splintering, thereby helping to prevent buildup of unseparated spent shale as the spherically-shaped bodies are cycled in the process.

Reheating of the spherically-shaped solids produces a continuous stream of hot heat carriers in the desired temperature range for recycle by way of retort inlet line 13 either by gravity and/or mechanical means to retort zone 12. As previously indicated, the rate of passage of the reheated spherically-shaped solids from the reheating zone will be metered or controlled in conventional manner to eventually provide the optimum heat carrier-to-oil shale feed stock ratio in the retort zone.

The foregoing description of preferred embodiments of the retorting process of this invention describes an improvement in oil shale retorting processes wherein a continuously restored, inclined surface separation stage is utilized to separate spherically-shaped solids from irregularly-shaped solids. This type of separation stage is especially advantageous for separating solids having an overlapping size range, for example, spent shale from solid heat carriers in an oil shale retorting process using porous, spherically-shaped pellets. The inclined surface separating system, however, may be used for separating other types of spherically-shaped solids from irregularly-shaped solids.

Figure 3:
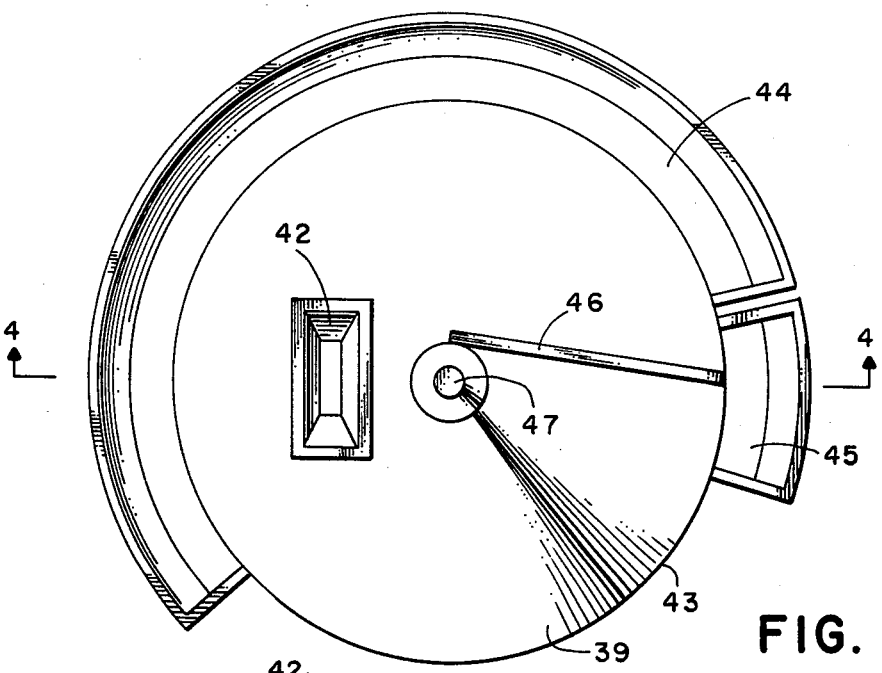
FIG. 3 is a top plan view of one embodiment for a separation system having a rotating, conically-shaped, inclined, table-like surface.
Figure 4:
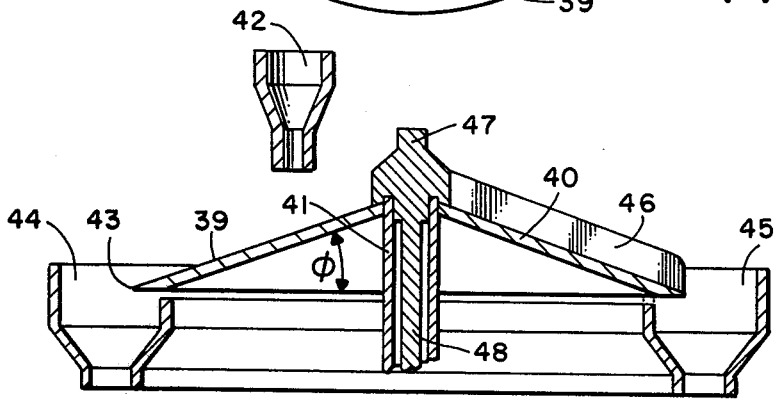
FIG. 4 is a sectionalized, side view of the system of FIG. 3.
Figure 5:
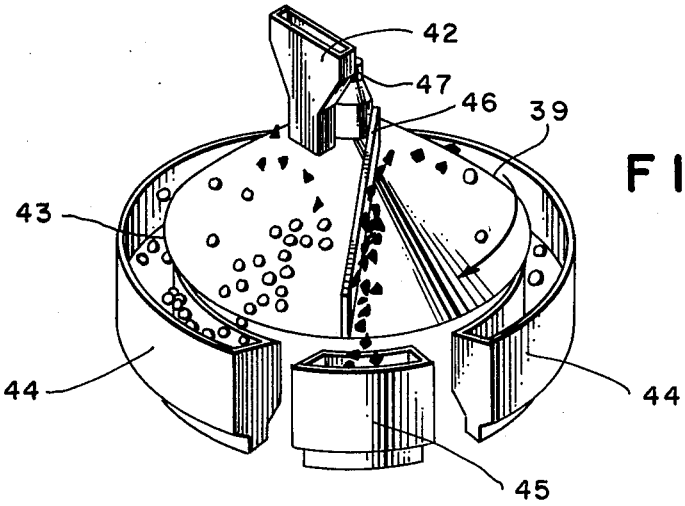
FIG. 5 is a pictorial, side view of a conically-shaped inclined surface illustrating how spherically-shaped rolling solids separate from irregularly-shaped solids as the surface rotates.

Preferred embodiments of the continuously restored, inclined surface separating system will now be described in more detail by having reference to FIGS. 3 through 11. FIGS. 3 through 5 show a conically-shaped inclined surface and FIGS. 6 through 11 show a conveyor belt-like inclined surface. These embodiments have certain common features which will be described first.

The inclined surface separating system is for separating spherically-shaped solids which tend to roll down an inclined surface from irregularly-shaped solids which tend to come to rest or slide down an inclined surface instead of rolling. In other words, the spherically-shaped solids are sufficiently round to roll down an inclined surface. On the other hand, the irregularly-shaped solids have one or more sides or surfaces which are flat or rough enough to cause the solids not to roll and to tend to come to rest or slide down the inclined surface.

The separating system of this invention separates solids by roll shape factor, that is, by the difference in rate of movement, e.g., rolling versus sliding, of solids fed onto an inclined surface. The surface is inclined at an angle from horizontal such that one of the spherically-shaped solids held at rest on the surface will upon release roll down the inclined surface. On the other hand, the angle of inclination is not sufficient to let the irregularly-shaped particles slide down the surface anywhere near as fast as the spherically-shaped solids roll down the surface. In other words, the irregularly-shaped solids have one or more flat or rough sides which cause the irregularly-shaped solids to tend to come to rest on or slide down an inclined surface. When one of these irregularly-shaped solids having a size equal to the size of the spherically-shaped solids is held at rest on the inclined surface with a flat or rough side against the surface, it will upon release substantially stay in place on the inclined surface. The angle of inclination thus defined takes into consideration the smoothness of the surface as well as the roll factor of the two classes of solids.

The inclined surface separating system has means for feeding a mixture of spherically-shaped and irregularly-shaped solids at a first point onto an impingement area of the inclined surface, and separate receiving means adapted to receive the spherically-shaped solids and the irregularly-shaped solids from the inclined surface. The inclined surface will have a lower portion and an upper portion and the supply means will feed the mixture of solids at one or more feed points onto an impingement area, that is, a part of the upper portion of the surface, so that the solids will not leave the surface before the rolling solids have had time to separate from the irregularly-shaped nonrolling solids.

The supply means and impingement surface area onto which the mixture of solids is fed coact so that the supply means and surface move relative to each other in a constant direction, and the impingement area is constantly changing and is constantly restored. In other words, either the supply means moves relative to the impingement surface area, or the impingement surface area moves relative to the supply means. It is usually more efficient to move the impingement surface area relative to the supply means or feed point. This coacting movement enables the impingement surface area to be continuously restored or renewed, that is, made clean or clear of solids of a significant size which were previously fed onto the inclined surface. Continuous restoration of the surface is necessary for adequate separation of the solids. It provides a contact area from which the rolling solids may roll and gain the necessary relative speed or movement to enable them to separate from the irregularly-shaped solids. Continuous movement of the impingement surface area in a constant direction enables the irregularly-shaped bodies or solids to be removed at a point which is away from the point where the mixture is fed onto the inclined surface. This movement may also be used to create forces which remove the irregularly-shaped solids from the inclined surface. Continuous restoration and movement reduces channeling of the solids and impacting or bouncing of the solids against each other. Continuous movement also increases the effective time and surface area over which the differences in relative roll factor may take effect. It also adds greatly to the adaptability of the system for changing solids contents, sizes and feed rates.

The final design and efficiency of the continuously restored, inclined surface separating system will depend on properties of the solids, for example, feed rate, momentum, and relative sizes and concentrations, and on the properties of the inclined surface, for example, angle of inclination, smoothness and rate of restoration. Other factors affecting efficiency will depend on the specific nature of the inclined surface separating system.

Returning now to the FIGS. 3 through 11, specific embodiments of the inclined surface separating system will be more specifically described.

FIGS. 3 through 5 relate to a dome-shaped or cone-shaped rotating table form of continuously restored, inclined surface separating system wherein rotation of the table causes the impingement surface area of the inclined surface to continually change and to move relative to the feed point so that the impingement area moves in a circular path. As shown, the inclined surface is formed by upper, outer conoidal surface 39 of conically-shaped member 40 whose apex points up. The conically-shaped member is adapted to rotate about its vertical axis or hollow rotatable cylindrical shaft 41 which may be rotated by any suitable means, which means will usually have a controlled and variable speed. The inclined surface is inclined from horizontal by angle $\phi$ which is adapted to cause spherically-shaped solids to roll down the surface faster than similarly sized, irregularly-shaped solids can slide down the surface so that the two types of solids may be separately collected. As previously stated, this angle is equal to or greater than the angle where a static spherically-shaped solid will roll and less than the angle at which a static irregularly-shaped solid of a similar size will slide. The slope or angle of inclination of the cone-shaped sides may be made adjustable to yield the optimum angle, but it is usually best to build the surface for the specific solids to be separated thereon.

Above a portion of the upper part of conoidal surface 39 is supply means 42 which is any sort system or systems, e.g., one or more chutes or passages, for feeding a mixture of spherically-shaped and irregularly-shaped solids onto an upper surface portion of conoidal surface 39.

Lower edge 43 of conoidal surface 39 is circular in shape. In line with and below a portion of this circular-shaped, lower edge is first receiving means 44 which is adapted to receive spherically-shaped solids rolling from inclined surface member 40. First receiving means 44 may be sectionalized or there may be more than one first receiving means. Sometimes it may be desirable to separate the rolling solids into various streams for cycle to another inclined surface system. Receiving means 44 is any sort of system, e.g., one or more troughs, catchers, or chutes, for receiving the spherically-shaped solids. This receiving system is located and positioned below and around the portion or portions of conically-shaped member 40 where the ball-like solids roll from the surface.

In line with and below another portion of circular-shaped, lower edge 43 of conoidal surface 39 is second receiving means 45 which is adapted to receive irregularly-shaped solids from inclined surface member 40. There may be more than one second receiving means 45 which is any sort of system or systems, e.g., one or more troughs, catchers, or chutes, for receiving the irregularly-shaped solids. This second receiving system is located and positioned below and around the portion or portions of conically-shaped member 40 where the irregularly-shaped solids leave the inclined surface.

As shown in FIGS. 3 through 5, removal means 46 is adapted to remove irregularly-shaped solids from conoidal surface 39 as conically-shaped member 40 is rotated about its vertical axis. Removal means 46 coacts wth movement or rotation of the surface of conically-shaped member 40 to create a downwardly directed component of a force which deflects or pushes the irregularly-shaped solids toward the end of removal means 46 which terminates at lower edge 43 adjacent and above second receiving means 45. Removal means 46 may be any sort of device or system, or a combination of devices or systems, for removing solids from a surface, for example, one or more scrapers, brushes or gas jets. The removal means will be adapted to remove the desired size solids. It is preferred that substantially all of the solids be removed except, perhaps, very fine dust. As shown, removal means 46 is a scraper with its lower edge parallel to conoidal surface 39 and close enough to the surface to scrape or clean off solids on the surface. Usually conoidal surface 39 will be smooth and uniform, but in instances where it is not, the scraper could be made of small, side-by-side sections adapted to ride on the surface. As shown, removal means 46 is stationary and is mounted at its upper end to hub 47 which in turn is mounted on stationary rod 48. Stationary rod 48 passes through the hollow cylindrical passage in rotatable cylindrical shaft 41. This permits rotation of conically-shaped member 40 without movement of removal means 46.

The operation of the continuously restored, conically-shaped inclined surface system is shown in FIG. 5. A mixture of spherically-shaped solids represented by white balls and irregularly-shaped solids represented by blackened particles is fed from supply means 42 at a first feed point onto a restored, upper impingement surface area portion of inclined conoidal surface 39. The impingement area or the feed point may be considered as having a first side or boundary and a second side which are used herein to describe the net constant direction of movement of the impingement area. When the mixture hits the surface, most of the spherically-shaped solids roll from the inclined surface where they fall into the trough-like opening of first receiving means 44 and are collected by the receiving means. Most, fifty percent or more by weight, of the irregularly-shaped solids which are fed onto inclined conoidal surface 39 remain on the inclined surface. Some of the spherically-shaped solids may be caught and held by the irregularly-shaped solids. At the same time, conicaly-shaped member 40 is rotated in a constant net direction and the spherically-shaped and irregularly-shaped solids remaning on conoidal surface 39 move in generally circular path away from the first side of the feed point where the mixture is fed onto the surface and a clean, continuously restored impingement surface is moved under the supply means. As the conically-shaped member is rotated, some of the trapped spherically-shaped solids will roll free from the irregularly-shaped solids and roll off the inclined conoidal surface into receiving means 40. Continued rotation of the conically-shaped member causes the irregularly-shaped solids to move away from the first side of the first feed point toward a second removal point and eventually back around to the second side of the feed point. As the irregularly-shaped solids on the inclined surface are thus moved in a first direction away from the feed point toward the removal point, the solids on the inclined surface contact or come under the influence of removing means 46. The combination of forces created by the deflecting force of the removal means and the circular sliding or moving of the inclined surface creates a resulting force with a downwardly directed component on the irregularly-shaped solids which causes the direction of movement of irregularly-shaped solids on the inclined surface to change direction so that the solids are removed adjacent the end of the removal means at a point well away from the point where the solids were originally fed onto conoidal surface 39. The irregularly-shaped solids are collected in second receiving means 45. A point on the surface continues in a circular path back to the feed point.

In the conically-shaped inclined surface embodiment, the rate of restoration of the surface is primarily controlled by the speed of rotation of the conically-shaped member 33. The degree of solids saturation on the inclined surface is primarily controlled by the rate of feed of the mixture, the speed of rotation, the rolling speed of the spherically-shaped bodies, and the ratio of spherically-shaped solids to irregularly-shaped solids in the feed mixture. The tendency of the irregularly-shaped solids to be removed from the inclined surface prematurely depends on their shape and specific gravity, impacts with the rolling particles, the angle of inclination, and the size and speed of rotation of the table. The separating system will be adjusted to obtain the necessary level of efficiency.

Figure 6:
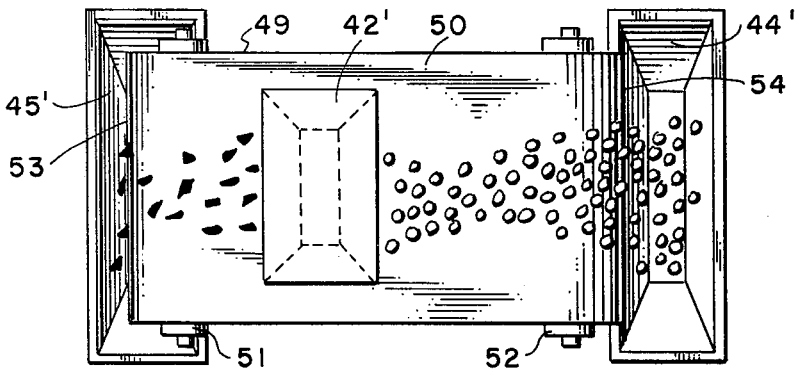
FIG. 6 is a top plan view of one embodiment for a separation system having a conveyor belt-like inclined surface and illustrates how spherically-shaped rolling solids are separated from irregularly-shaped solids.
Figure 7:
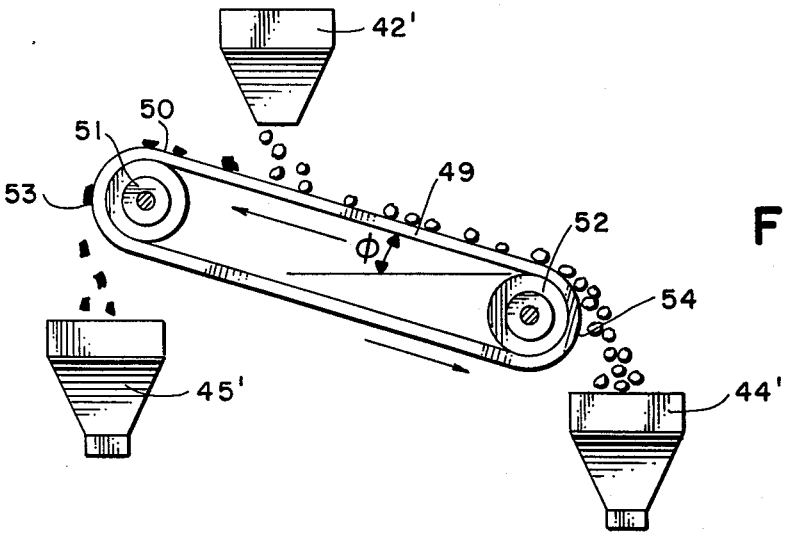
FIG. 7 is a side view of the system of FIG. 6.

An inclined conveyor belt-like separating system is shown in FIGS. 6 and 7 wherein elongated, inclined, conveyor belt-like member 49 having uppermost inclined surface 50 is rotated by any suitable, controllable means upward over and around upper end member 51 and downward under and around lower end member 52. The conveyor belt-like member has upper end 53 and lower end 54 and is inclined from horizontal along its longitudinal axis by angle $\phi$ so that upper end 53 is at a higher elevation than lower end 54. The effective separating surface area of the conveyor belt-like member is the area between the points of removal of the spherically-shaped solids and the irregularly-shaped solids. In the embodiment illustrated in FIGS. 6 and 7, the effective area is the area between upper end 53 and lower end 54. For descriptive purposes, it will be noted that inclined surface 50 may be divided into a lower part and an upper part.

Above a portion of the upper part of inclined surface 50 is supply means 42' which is adapted for feeding a mixture of spherically-shaped solids and irregularly-shaped solids at a first feed point onto a portion of inclined surface 50. As previously noted, the first feed point may be considered as having a first boundary and a second boundary.

Below lower end 54 is first receiving means 44' which is positioned and adapted to receive spherically-shaped solids rolling from inclined surface 50.

Below upper end 53 is second receiving means 45' which is positioned and adapted to receive irregularly-shaped solids falling from the upper end of inclined surface 50.

The angle of inclination of conveyor belt-like member 49 is such that spherically-shaped solids fed onto inclined surface 50 will roll down the inclined surface much faster than irregularly-shaped solids fed onto the inclined surface will slide down the surface. The factors determining the necessary angle of inclination have been previously mentioned except that in this embodiment the inclined surface moves in a counter or opposite direction than the direction in which the spherically-shaped solids roll.

The operation of the continuously restored, inclined conveyor belt-like system is illustrated in FIGS. 6 and 7. A mixture of the two types of solids is fed from supply means 42' at a first feed point onto a continuously changing, restored, upper impingement surface area portion of inclined surface 50. When the mixture hits the surface, most of the spherically-shaped solids roll from the inclined surface and fall into the trough-like opening of first receiving means 44' where they are collected by the receiving means. Most of the irregularly-shaped solids which are fed onto inclined surface 50 remain on the inclined surface. At the same time, the surface area of conveyor belt-like member 49 is rotated in a constant net longitudinal direction relative to the feed point where supply means 42' feeds the mixture onto the inclined surface. This continuously changes the impingement area of the conveyor belt-like member and moves the surface past the supply means in an upwardly inclined direction parallel to the longitudinal axis of the conveyor belt-like member. The continuously changing impingement area of the inclined surface will be essentially clear of spherically-shaped solids and/or irregularly-shaped solids except, perhaps, for a small percentage of irregularly-shaped solids whose momentum might have carried them down the inclined surface for a short distance or that might have been knocked or carried down the inclined surface by the spherically-shaped solids and then caught hold of the moving surface and moved back up past the supply means.

As the inclined surface is moved or rotated upward around upper end 53, the portion of the conveyor belt-like member with irregularly-shaped solids thereon moves away from the first side of the first feed point and moves up around the upper end of the conveyor belt-like member and then around upper end 53 back to and around lower end 54 to the second side of the feed point to repass below supply means 42'. As the part of the conveyor belt-like member moves in a conveyor belt-type path, the irregularly-shaped solids fall off the conveyor belt-like member into the trough-like opening in second receiving means 45'. The irregularly-shaped solids are thus removed from inclined surface 50.

The rate of restoration of the inclined surface is primarily controlled by the speed of rotation of conveyor belt-like member 49. The degree of solids saturation on the inclined surface is primarily controlled by the feed rate of the mixture, the speed of rotation of the conveyor belt-like member, the rolling speed of the spherically-shaped solids, and the rate of removal of the solids. The tendency of the wrong type of solid to be removed at the wrong end of the conveyor belt-like member is primarily dependent on the rate of restoration of the inclined surface, the solids saturation on the inclined surface, the shape and specific gravity of the solids, the amount of impacts between the solids, the angle of inclination, and the size of the belt. The separating system will be adjusted to obtain the necessary separating efficiency level.

Figure 8:
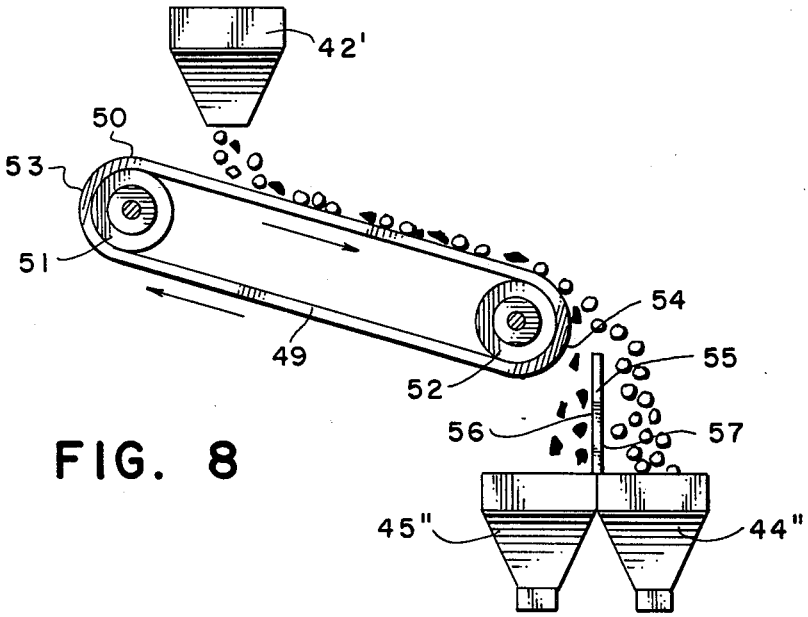
FIG. 8 is a side view of another conveyor belt-like embodiment of a separation system and shows how spherically-shaped rolling solids are separated by rotation of the inclined belt and a spaced-apart deflector plate.

The conveyor belt-like system of FIG. 8 is similar to the separating system of FIGS. 6 and 7 except that conveyor belt-like member 49 is rotated downward and around lower end 54 and upward and around upper end 53, and the receiving means for the solids are relocated and separated by deflector means 55. First receiving means 44'' and second receiving means 45'' are both positioned near lower end 54 of the conveyor belt-like member and at an elevation below this lower end. The first receiving means for collecting the spherically-shaped solids is positioned in a longitudinal direction further out and away from lower end 54 than the second receiving means for collecting the irregularly-shaped solids. The trough-like openings in the tops of the two receiving means are separated by deflector means 55 so that second receiving means 45'' will catch solids falling from lower end 54 on near side 56 of the deflector means, and so that first receiving means 44'' will catch solids falling to far side 57 of the deflector means. The deflector means may be any sort of separating or dividing device, e.g., a vertically extending plate or baffle. The deflector means will be spaced beyond the lower end of the conveyor belt-like member by a distance such that most of the irregularly-shaped solids on inclined surface 50 will fall between near side 56 and lower end 54, and by a distance such that most of the spherically-shaped solids leaving inclined surface 50 will fall on far side 57 so that deflector means 55 will be between lower end 54 and the points where most of the shperically-shaped solids fall into first receiving means 44''.

In operation, a mixture of spherically-shaped solids and irregularly-shaped solids is fed from supply means 42' onto a restored, upper surface portion of inclined surface 50. At the same time, conveyor belt-like member 49 is rotated in a constant longitudinal direction down and around lower end 54. This movement of the inclined surface relative to the supply means presents a continuously restored surface essentially clear of solids for receipt of the mixture of solids from the supply means. When the mixture hits the surface, the spherically-shaped solids start rolling down the inclined surface. Their speed is combined with the rate of movement of the conveyor belt-like member. Most of the spherically-shaped solids leave the inclined surface at a speed which carries them outward away from lower end 54 and over deflector means 55 so that most of them fall into first receiving means 44''. In contrast, the irregularly-shaped solids simply move with the conveyor belt-like member and fall off lower end 54 between near side 56 of deflector means 55 and the lower end of the conveyor belt-like member. The irregularly-shaped solids fall into second receiving means 45''.

Figure 9:
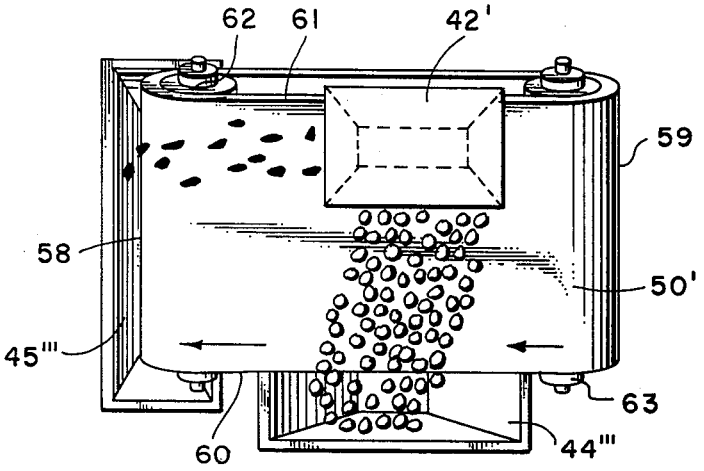
FIG. 9 is a top plan view of still another conveyor belt-like embodiment of a separation system wherein the belt is tilted sideways and shows how the spherically-shaped rolling solids are separated from the irregularly-shaped solids.
Figure 10:
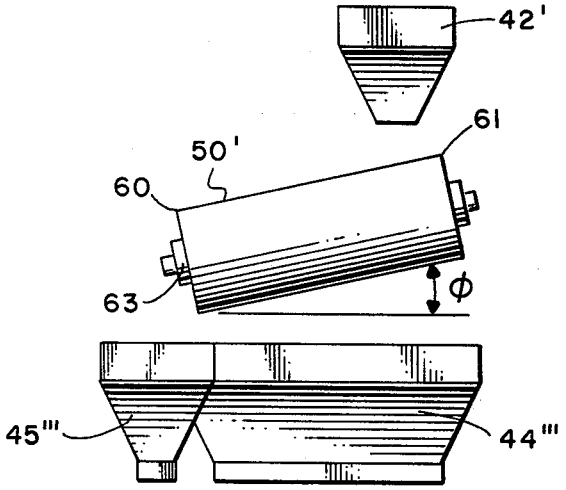
FIG. 10 is an end view of the system of FIG. 9.
Figure 11:
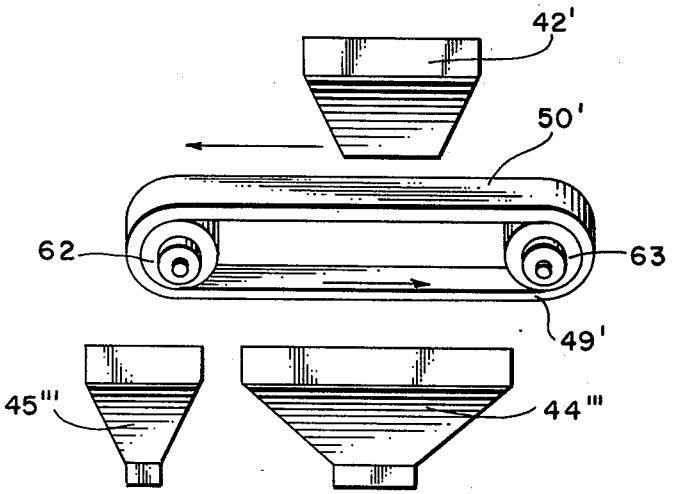
FIG. 11 is a side view of the system of FIG. 10.

Another embodiment of an inclined conveyor belt-like separating system is shown in FIGS. 9 through 11 wherein the conveyor belt-like member is tilted sideways instead of being tilted along its longitudinal axis. As shown, conveyor belt-like member 49' with uppermost side or inclined surface 50' has left end 58 and right end 59 and is inclined downward to one side so that inclined surface 50' has lower lengthwise edge 60 forming a lower boundary for a lower portion of the inclined surface and has upper lengthwise edge 61. The conveyor belt-like member is inclined from horizontal by angle $\phi$ so that upper edge 61 is at a higher elevation than lower edge 60 and inclined surface 50' is inclined downwardly toward one side of the conveyor belt-like member.

Above an initial impingement area portion of the upper part of inclined surface 50' is supply means 42' which is adapted for feeding a mixture of spherically-shaped solids and irregularly-shaped solids onto an impingement area portion of inclined surface 50'. As shown, conveyor belt-like member 49' is adapted to rotate sideways toward left end 58 around left end member 62 toward right end member 63 and back past supply means 42'.

Below lower edge 60 is first receiving means 44''' which is positioned and adapted to receive spherically-shaped solids rolling from inclined surface 50' over lower edge 60.

Below left end 58 is second receiving means 45''' which is positioned and adapted to receive irregularly-shaped solids falling from inclined surface 50' as it is rotated around left end 58.

The width of the conveyor belt-like member will be sized so that the effective separating surface area will be sufficiently large to allow spherically-shaped solids to separate according to roll factor from irregularly-shaped solids when a mixture of the two types of solids is fed onto inclined surface 50'. The effective surface area of inclined surface 50' of the conveyor belt-like member shown in FIGS. 9 through 11 is the area starting with supply means 42' and ending with left end 58.

In operation, a mixture of spherically-shaped solids and irregularly-shaped solids is fed from supply means 42' onto a continually restored, upper surface portion of inclined surface 50'. At the same time, conveyor belt-like member 49' is rotated in a constant direction toward left edge 58 and around left edge 58 back toward and around right edge 59. This movement of the inclined surface relative to the point where supply means 42' feeds the mixture onto the inclined surface presents a continuously restored initial impingement surface area essentially clean of solids for receipt of a mixture of solids from the supply means. When the mixture hits the surface, most of the spherically-shaped solids roll down the inclined surface over lower edge 60 into first receiving means 44'''. At the same time, most of the irregularly-shaped solids remain on a portion of the inclined surface which portion moves from the left side of the feed point with the conveyor belt-like member around left end 58 where the irregularly-shaped solids fall into second receiving means 45'''. The now clean portion of the inclined surface moves around right end 59 and back past the right side of the feed point under supply means 42'.

EXAMPLE

A side stream of spherically-shaped solids and irregularly-shaped solids is taken from a mixture of solids that has previously been processed to separate larger and smaller sized irregularly-shaped solids. The side stream contains spherically-shaped solids in a size range between about 0.14 centimeter and 0.953 centimeter, and about 1.94 percent by weight of irregularly-shaped solids in the same size range. The side stream is fed at a rate of about 208.7 metric tons (230 U.S. short tons) per day onto a three section 4.57 meter (15 foot) diameter table having a conically-shaped separating surface inclined from horizontal at an angle of inclination of 10° . The table is rotated at a speed of 7.5 rpm. The separation efficiency is about 90% with a spherically-shaped solids loss of about 0.075 kilogram per metric ton (0.15 pounds per U.S. short ton) of solids processed on the separating table.

Reasonable variations and modifications are practical within the scope of this disclosure without departing from the spirit and scope of the claims of this invention. For example, while only single section, continuously restored inclined surface separating systems have been described, it is to be understood that any such system could be comprised of more than one section and more than one stage.

The embodiments of the invention in which an exclusive property or privilege is claimed are defined as follows:

1. In a method for retorting crushed oil shale containing carbonaceous organic matter and mineral matter wherein oil shale is retorted by contacting said oil shale with hot heat-carrying spherically-shaped solids in a retort zone to produce gas and oil products and a mixture of said spherically-shaped solids and irregularly-shaped particulate spent shale, and wherein at least eighty percent by weight of said spherically-shaped solids are reheated and recycled to said retort zone and at least 75 percent by weight of the spent shale is separated from said mixture and disposed, the improvement comprising:

a. feeding a mixture of spherically-shaped solids and spent shale at a first point having a first side and a second side onto an initial impingement area of an inclined surface whereon most of said spherically-shaped solids fed onto said inclined surface roll from said inclined surface while most of said spent shale fed onto said inclined surface remains on said inclined surface;

b. moving the portion of said inclined surface with spent shale thereon during the time that step (a) is taking place in a direction such that said impingement area of said inclined surface is constantly changing and said portion moves away from said first side of said first point and returns to said second side of said first point before said portion returns to said first side of said first point;

c. collecting the spherically-shaped solids which have rolled from said inclined surface, and d. removing spent shale from said inclined surface at a second point located away from said first point where said spherically-shaped solids and spent shale are fed onto said inclined surface in step (a).

2. The method according to claim 1 wherein the spherically-shaped solids are spherically-shaped pellets comprised of particulate solid heat carriers in a size range between approximately about 0.14 centimeter and 1.27 centimeters and have a surface area of between 10 and 150 square meters per gram and wherein in the retort zone there is produced an organic combustible deposition on said pellets.

3. The method according to claim 2 wherein the particulate solid heat carriers are in a size range between approximately about 0.14 centimeter and 0.953 centimeter.

4. The method according to claim 1 wherein in step (b), the portion of the inclined surface is moved in a circular path around a vertical axis of said inclined surface.

5. The method according to claim 1 wherein in step (b), the portion of the inclined surface is moved in a path similar to the path that a point on the surface of a moving conveyor belt travels in leaving and returning to a predetermined location.

6. The method according to claim 1 wherein in step (d), the spent shale is removed at the second point by moving spent shale on the inclined surface in a first direction and then moving said spent shale while it is still on said inclined surface in a second direction substantially different from said first direction.

7. A method for retorting crushed oil shale containing carbonaceous organic matter and mineral matter using heat-carrying, spherically-shaped solids and for separating and recovering said spherically-shaped solids for reuse in the retorting method, which method comprises:

a. feeding crushed oil shale and spherically-shaped solids to a retort zone, said spherically-shaped solids being at a retort zone inlet temperature of between 538° C. and 760° C. and in a quantity such that the sensible heat in said spherically-shaped solids is sufficient to provide at least fifty percent of the heat required to heat said crushed oil shale from its retort zone feed temperature to a retort zone outlet temperature of between 427° C. and 621° C.;

b. retorting in said retort zone gas and oil products from said crushed oil shale, thereby forming a mixture of spherically-shaped solids and irregularly-shaped particulate spent shale;

c. recovering said gas and oil products generated by retorting said crushed oil shale;

d. passing said mixture of spherically-shaped solids and spent shale from said retort zone to a solids separation and recovery zone and separating on an average at least seventy-five percent by weight of said spent shale from said mixture and recovering on an average at least 90 percent by weight of the spherically-shaped solids in said mixture, said separating and recovering comprising:

(1) passing a mixture of spherically-shaped solids and spent shale onto an initial impingement area of an inclined surface at a first point having a first side and a second side whereon most of said shperically-shaped solids fed onto said inclined surface roll from said inclined surface while most of said spent shale fed onto said inclined surface remains on said inclined surface;

(2) moving the portion of said inclined surface with spent shale thereon during the time that step (1) is taking place in a direction such that said impingement area of said inclined surface is constantly changing and said portion moves away from said first side of said first point and returns to said second side of said first point before said portion returns to said first side of said first point;

(3) collecting the spherically-shaped solids which have rolled from said inclined surface, and (4) removing spent shale from said inclined surface at a second point located away from said first point where said spherically-shaped solids and spent shale are fed onto said inclined surface in step (1).

8. The method according to claim 7 wherein the spherically-shaped solids are spherically-shaped pellets comprised of particulate solid heat carriers in a size range between approximately about 0.14 centimeter and 1.27 centimeters and have a surface area of between 10 and 150 square meters per gram and wherein in the retort zone there is produced an organic combustible deposition on said pellets.

9. The method according to claim 8 wherein the particulate solid heat carriers are in a size range between approximately about 0.14 centimeter and 0.953 centimeter.

10. The method according to claim 7 wherein in step (2) of step (*d*), the portion of the inclined surface is moved in a circular path around a vertical axis of said inclined surface.

11. The method according to claim 10 wherein the spherically-shaped solids are spherically-shaped pellets comprised of particulate solid heat carriers in a size range between approximately about 0.14 centimeter and 1.27 centimeters and have a surface area of between 10 and 150 square meters per gram and wherein in the retort zone there is produced an organic combustible deposition on said pellets.

12. The method according to claim 11 wherein the particulate solid heat carriers are in a size range between approximately about 0.14 centimeter and 0.953 centimeter.

13. The method according to claim 7 wherein in step (2) of step (*d*), the portion of the inclined surface is moved in a path similar to the path that a point on the surface of a moving conveyor belt travels in leaving and returning to a predetermined location.

14. The method according to claim 13 wherein the spherically-shaped solids are spherically-shaped pellets comprised of particulate solid heat carriers in a size range between approximately about 0.14 centimeter and 1.27 centimeters and have a surface area of between 10 and 150 square meters per gram and wherein in the retort zone there is produced an organic combustible deposition on said pellets.

15. The method according to claim 14 wherein the particulate solid heat carriers are in a size range between approximately about 0.14 centimeter and 0.953 centimeter.

16. The method according to claim 7 wherein in step (4) of step (*d*), the spent shale is removed at the second point by moving spent shale on the inclined surface in a first direction and then moving said spent shale while it is still on said inclined surface in a second direction substantially different from said first direction.

17. The method according to claim 16 wherein the spherically-shaped solids are spherically-shaped pellets comprised of particulate solid heat carriers in a size range between approximately about 0.14 centimeter and 1.27 centimeters and have a surface area of between 10 and 150 square meters per gram and wherein in the retort zone there is produced an organic combustible deposition on said pellets.

18. The method according to claim 17 wherein the particulate solid heat carriers are in a size range between approximately about 0.14 centimeter and 0.953 centimeter.

19. The method according to claim 7 wherein prior to step (1) of step (*d*), the mixture of spherically-shaped solids and spent shale from the retort zone is passed through a first separation stage to remove at least a portion of the spent shale larger than said spherically-shaped solids.

20. The method according to claim 19 wherein the spherically-shaped solids are spherically-shaped pellets comprised of particulate solid heat carriers in a size range between approximately about 0.14 centimeter and 1.27 centimeter and have a surface area of between 10 and 150 square meters per gram and wherein in the retort zone there is produced an organic combustible deposition on said pellets.

21. The method according to claim 20 wherein the particulate solid heat carriers are in a size range between approximately about 0.14 centimeter and 0.953 centimeter.

22. The method according to claim 19 wherein the mixture of spherically-shaped solids and spent shale remaining after the first separation stage is passed through a second separation stage to remove at least a portion of the spent shale smaller than said spherically-shaped solids, and at least a portion of the mixture of spherically-shaped solids and spent shale remaining after the second separation stage is fed in step (1) of step (*d*) onto the inclined surface.

23. The method according to claim 22 wherein the spherically-shaped solids are spherically-shaped pellets comprised of particulate solid heat carriers in a size range between approximately about 0.14 centimeter and 1.27 centimeter and have a surface area of between 10 and 150 square meters per gram and wherein in the retort zone there is produced an organic combustible deposition on said pellets.

24. The method according to claim 23 wherein the particulate solid heat carriers are in a size range between approximately about 0.14 centimeter and 0.953 centimeter.

25. The method according to claim 22 wherein in step (2) of step (*d*), the portion of the inclined surface is moved in a circular path around a vertical axis of said inclined surface.

26. The method according to claim 22 wherein in step (2) of step (*d*), the portion of the inclined surface is moved in a path similar to the path that a point on the surface of a moving conveyor belt travels in leaving and returning to a predetermined location.

27. The method according to claim 22 wherein in step (4) of step (*d*), the spent shale is removed at the second point by moving spent shale on the inclined surface in a first direction and then moving said spent shale while it is still on said inclined surface in a second direction substantially different from said first direction.

28. The method according to claim 7 wherein prior to step (1) of step (*d*), a mixture of spherically-shaped solids and spent shale is passed through a separation stage to remove at least a portion of the spent shale smaller than said spherically-shaped solids, and at least a portion of the mixture of spherically-shaped solids and spent shale remaining after said separation stage is fed in step (1) onto the inclined surface.

29. The method according to claim 28 wherein the spherically-shaped solids are spherically-shaped pellets comprised of particulate solid heat carriers in a size range between approximately about 0.14 centimeter and 1.27 centimeter and have a surface area of between 10 and 150 square meters per gram and wherein in the retort zone there is produced an organic combustible deposition on said pellets.

30. The method according to claim 29 wherein the particulate solid heat carriers are in a size range between approximately about 0.14 centimeter and 0.953 centimeter.

31. The method according to claim 28 wherein in step (2) of step (*d*), the portion of the inclined surface is moved in a circular path around a vertical axis of said inclined surface.

32. The method according to claim 28 wherein in step (2) of step (*d*), the portion of the inclined surface is moved in a path similar to the path that a point on the surface of a moving conveyor belt travels in leaving and returning to a predetermined location.

33. The method according to claim 28 wherein in step (4) of step (*d*), the spent shale is removed at the second point by moving spent shale on the inclined surface in a first direction and then moving said spent shale while it is still on said inclined surface in a second direction substantially different from said first direction.

* * * * *